US012807892B2

(12) United States Patent
Faye et al.

(10) Patent No.: US 12,807,892 B2
(45) Date of Patent: Nov. 24, 2026

(54) SPECIFIC ORGANOPHOSPHORUS COMPOUNDS AS NON-NEUROTOXIC ANTI-WEAR AGENTS

(71) Applicant: NYCO, Paris (FR)

(72) Inventors: Djibril Faye, Eragny (FR); Marion Gay, Cergy (FR); Florence Severac, Gargenville (FR); Grégoire Herve, Paris (FR)

(73) Assignee: NYCO, Paris (FR)

( * ) Notice: Subject to any disclaimer, the term of this patent is extended or adjusted under 35 U.S.C. 154(b) by 843 days.

(21) Appl. No.: 17/926,218

(22) PCT Filed: May 18, 2021

(86) PCT No.: PCT/EP2021/063201
§ 371 (c)(1),
(2) Date: Nov. 18, 2022

(87) PCT Pub. No.: WO2021/233947
PCT Pub. Date: Nov. 25, 2021

(65) Prior Publication Data

US 2023/0183592 A1 Jun. 15, 2023

(30) Foreign Application Priority Data

May 20, 2020 (FR) ..... 2005251

(51) Int. Cl.
*C10M 137/04* (2006.01)
*C10N 30/00* (2006.01)
*C10N 30/06* (2006.01)
*C10N 40/13* (2006.01)

(52) U.S. Cl.
CPC ..... *C10M 137/04* (2013.01); *C10M 2223/04* (2013.01); *C10N 2030/06* (2013.01); *C10N 2030/64* (2020.05); *C10N 2040/13* (2013.01)

(58) Field of Classification Search
CPC ..... C10M 137/04; C10M 2223/04
See application file for complete search history.

(56) References Cited

U.S. PATENT DOCUMENTS

| | | | |
|---|---|---|---|
| 3,983,046 | A | 9/1976 | Sheratte |
| 2012/0101015 | A1 | 4/2012 | Frapin et al. |
| 2016/0002565 | A1 | 1/2016 | Schmid et al. |
| 2019/0277339 | A1 | 9/2019 | Jaiswal et al. |

FOREIGN PATENT DOCUMENTS

| | | |
|---|---|---|
| FR | 2 924 122 | 5/2009 |
| WO | 2009/071857 | 6/2009 |
| WO | 2010/149690 | 12/2010 |
| WO | 2016/032246 | 3/2016 |

OTHER PUBLICATIONS

International Search Report dated Jul. 21, 2021, for PCT/EP2021/063201, 7 pp.
Written Opinion of the ISA dated Jul. 21, 2021, for PCT/EP2021/063201, 12 pp.
Siqi Zhang et al., "Screening for neurotoxic potential of 15 flame retardants using freshwater planarians", Neurotoxicology and Teratology, vol. 73, Mar. 31, 2019, pp. 54-66.
George L. Ellman et al, "A New and Rapid Colorimetric Determination of Acetylcholinesterase Activity", Biochemical Pharmacology, vol. 7, 1961, pp. 88-95.
Carl R. Mackerer et al., "Comparison of Neurotoxic Effects and Potential Risks From Oral Administration or Ingestion of Tricresyl Phosphate and Jet Engine Oil Containing Tricresyl Phosphate", Journal of Toxicology and Environmental Health, Part A, vol. 56, 1999, pp. 293-328.
G. De Nola et al., "Determination of ortho-cresyl phosphate isomers of tricresyl phosphate used in aircraft turbine engine oils by gas chromatography and mass spectrometry", Journal of Chromatography A, vol. 1200, 2008, pp. 211-216.
Peter H. Craig et al., "Evaluation of the hazards of industrial exposure to tricresyl phosphate: a review and interpretation of the literature", Journal of Toxicology and Environmental Health Part B: Critical Reviews, vol. 2, 1999, pp. 281-300.
Oksana Sirenko et al., "Functional and Mechanistic Neurotoxicity Profiling Using Human iPSC-Derived Neural 3D Cultures", Toxicological Sciences, vol. 167, No. 1, 2019, pp. 58-76.
A.V. Terry Jr., "Functional consequences of repeated organophosphate exposure: Potential non-cholinergic mechanisms", Pharmacology & Therapeutics, vol. 134, 2012, pp. 355-365.
Gaiqing Zhao et al., Hydroquinone bis(diphenyl phosphate) as an Antiwear/Extreme Pressure Additive in Polyalkylene Glycol for Steel/Steel Contacts at Elevated Temperature, Industrial & Engineering Chemistry Research, vol. 52, 2013, pp. 7419-7424.
Arnaud S. Karaboga et al., "Benchmarking of Hpcc: A novel 3D molecular representation combining shape and pharmacophoric descriptors for efficient molecular similarity assessments", Journal of Molecular Graphics and Modelling, vol. 41, 2013, pp. 20-30.
Kaspar Solbu et al., "Organophosphates in aircraft cabin and cockpit air-Method development and measurements of contaminants", Journal of Environmental Monitoring, vol. 13, 2011, pp. 1393-1403.
Abdullah M. Al-Salem et al., "Organophosphorus flame retardant (tricresyl phosphate) trigger apoptosis in HepG2 cells: Transcriptomic evidence on activation of human cancer pathways", Chemosphere, vol. 237, 2019, pp. 1-13.

*Primary Examiner* — Paul V Ward
(74) *Attorney, Agent, or Firm* — NIXON & VANDERHYE

(57) ABSTRACT

Disclosed is the use of specific organophosphorus compounds as anti-wear agents in an oil so as to prevent and/or reduce the neurotoxicity of the oil and/or for the prophylaxis of aerotoxic syndrome in the instance of a fume event.

21 Claims, 1 Drawing Sheet

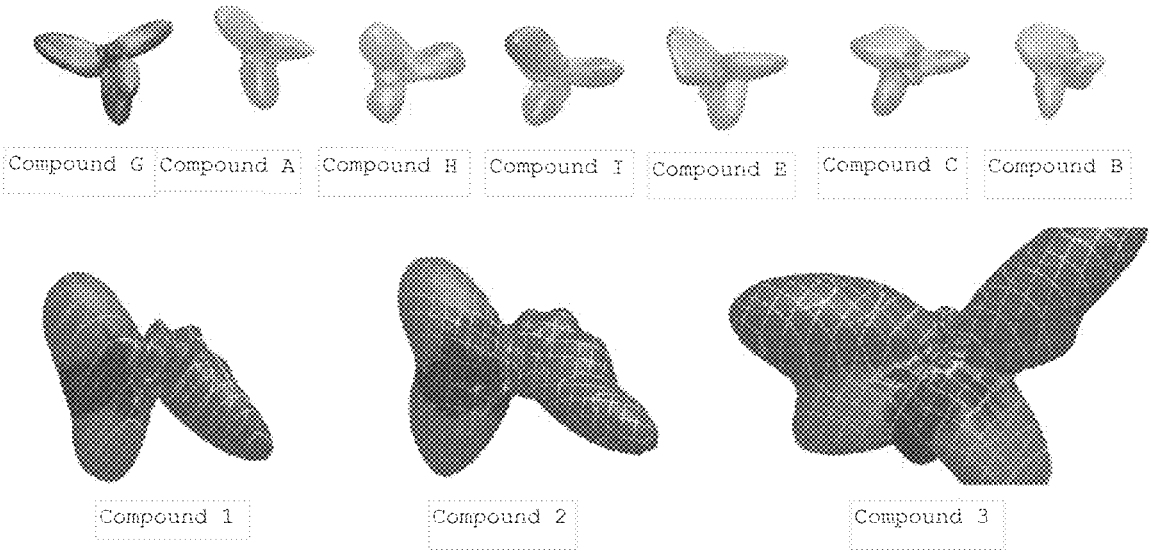
Compound G
Compound A
Compound H
Compound I
Compound E
Compound C
Compound B
Compound 1
Compound 2
Compound 3

SPECIFIC ORGANOPHOSPHORUS COMPOUNDS AS NON-NEUROTOXIC ANTI-WEAR AGENTS

CROSS-REFERENCE TO RELATED APPLICATION(S)

This application is the U.S. national phase of International Application No. PCT/EP2021/063201 filed May 18, 2021, which designated the U.S. and claims priority to FR 2005251 filed May 20, 2020, the entire contents of each of which are hereby incorporated by reference.

TECHNICAL FIELD

The present invention relates to the technical field of anti-wear additives used in oils such as oils for lubricating aircraft or aeroderivative turbines or hydraulic oils.

TECHNOLOGICAL BACKGROUND

Aircraft or aeroderivative turbine engines use synthetic lubricants generally comprising an ester base and a variety of anti-wear additives from the family of organophosphates such as triaryl phosphates. The most commercially used anti-wear additive is tricresyl phosphate (TCP), which has singular anti-wear properties that can be considered as unique to date. Its triaryl phosphate analogs are also interesting anti-wear additives.

Leakage of lubricants, especially those containing tricresyl phosphate or a triaryl phosphate analog thereof; in the aircraft cabin air may originate from worn or faulty seals, or even under normal conditions of use by the passage of the lubricants in the air for pressurizing the cabin. These repeated leaks are explained (Michaelis S. et al. *Public Health Panorama* 2017, 3, 2, p 198-211) as being due to pressure oscillations between the bearing chamber and the air circuit exerted by the normal operating conditions (increase in engine power, take-off, . . . ). In some circumstances, the leak can become very significant, usually subsequent to the break of a bearing in the turbine, the latter leading to a fume event or a white mist visible in the cabin.

Aerotoxic syndrome is a pathological condition combining physical and neurological symptoms caused by short and long-term effects of an exposure to aircraft cabin air contaminated by hydraulic oils or engine oils or any other organic pollutant found as gases and/or aerosols. The reported symptoms are typically non-specific, and the cabin air quality monitoring studies indicate contaminant levels which are lower than the limits of exposure and not harmful to human health, the challenge being to measure continuously and in operation fumes from oils, by definition non-gaseous, airborne, which deposit and concentrate episodically at various locations in the aircraft (Kasper Solbu et al. *J. Environ. Monit.* 2011, 13, 1393).

Symptoms similar to those of the aerotoxic syndrome can also be observed in environments on the ground in the presence of aeroderivative turbines, for example on offshore platforms. Aeroderivative turbines operate in the same way as aircraft turbines and are implementing lubricants of similar composition, especially in terms of anti-wear agents.

Nevertheless, a number of studies (Michaelis, S. et al. Public Health Panorama 2017, 3, 2, p. 198-211) have demonstrated a relative causal relationship between acute and/or chronic exposure to substances contaminating the aircraft cabin air and neurological, neurobehavioral and respiratory symptoms.

Conventional organophosphate anti-wear additives such as tricresyl phosphate (TCP), especially the tri-orthocresyl phosphate (ToCP) isomer thereof, are known to have a strong neurotoxic effect (Craig P. et al. *Journal of Toxicology and Environmental Health* Part B: Critical Reviews 1999, 2, 4, p. 281-300) Beyond the generic toxicity associated with the organophosphates widely used in various fields, particularly as insecticides and pesticides, one of the specified and recognized reasons for this neurotoxic effect is the fast in vivo conversion of tricresyl phosphate isomers comprising at least one ortho substitution into a metabolite called saligenin which is a potent inhibitor of cholinesterases. ToCP poisoning leads to a pathology called organophosphate-induced delayed neuropathy (OPIDN) whose mechanism has been extensively studied. Furthermore, the TCP being also known to be reprotoxic.

Oils comprising, as an anti-wear additive, TCP which does not include ortho isomer have been developed. Nevertheless, despite the absence of ToCP in the TCP, the inhibition level of cholinesterases in the rat serum exposed to TCP is not zero and, although low, it is persistent (Mackerer C R et al. *J. Toxicol. Env Health* Part A 1999 57 (5): 293-328). Similarly, earlier works show problems of spinal cord demyelination resulting from exposure to TCP in its meta and para forms (W. N. Aldridge, *Biochemical Journal* 1954 56, 185-189)

Very recent studies show that tricresyl phosphate and its triaryl phosphate analogs also act on other biological targets, especially at the cellular level (AV Terry, *Pharmacology and Therapeutics* 2012, 134, p. 355-365; Al Salem et al. *Chemosphere* 2019, 237, 124519).

All of these studies and this long history constitute a body of evidence and elements which made the tricresyl phosphate and its triaryl phosphate analogs additives of particular concern.

In order to increase the safety level of hydraulic oils and oils used in aircraft and aeroderivative turbines, it seems to be useful to develop alternative anti-wear additives to tricresyl phosphate and its triaryl phosphate analogs.

Identification of alternative anti-wear additives to tricresyl phosphate and its triaryl phosphate analogs is an identified issue, even if there is no unanimity on the need to obviate tricresyl phosphate and its triaryl phosphate analogs.

To the Applicant's knowledge, no studies have identified alternative anti-wear additives having both satisfactory anti-wear effect and proven non-neurotoxicity. As an example, recent studies on the characterization of the potential neurotoxicity of new organophosphates developed and marketed as new generation flame retardants are for the most part of a level of hazard allegedly equivalent to that of usual materials like the TCP (Zhang et al. *Neurotoxicology and Teratology* 2019, 73, p. 54-66, Ryan et al. *Neurotoxicology* 2016, 53, 271-281, Sirenko et al. *Toxicolog. Sci.* 2019, 167, p. 58-76). The issue of organophosphorus compound neurotoxicity remains unanswered and unresolved to date.

Various solutions have been developed in the prior art.

The patent application US2016/0002565 discloses a turbine oil free of tricresyl phosphate which comprises at least one basic oil, at least one alkyl polyglycoside and a phenolic derivative such as 3,5-di-tert-butyl-hydroxytoluene. Replacing tricresyl phosphate with phenolic derivative helps to prevent aerotoxic syndrome when this oil is used in aircraft turbines. Nevertheless, the implementation of such an oil in aircraft turbines seems not to be able to provide the same effectiveness as that of the oil containing tricresyl phosphate it is supposed to replace, on one hand because the described formulation does not include any agent having an anti-wear effect replacing that of the TCP, and on the other hand because the formulation comprises alkyl polyglycosides which are heat-sensitive.

So far, only phosphorus compounds showed efficient effectiveness as anti-wear agents in oils for aircraft or aeroderivative turbines. Without intending to be bound by any theory, this may be related to the fact that the phosphorus enables the formation of a protective layer; commonly referred to as tribofilm, even at the high temperatures involved by the intended applications.

The patent application WO2010/149690 discloses the reduced effect on butyrylcholinesterase, especially in relation to TCP, of specific triaryl phosphates wherein the phenyl moieties are substituted by one to three isopropyle or tert-butyl moieties. These inhibition results suggest a possible reduction in neurotoxicity associated with these compounds compared to that observed for the TOP. Nevertheless, the simple demonstration of a limited effect on a single cholinesterase seems not to be enough to ensure a sufficient safety level for aviation expectations.

The following documents are also known from the prior art.

Document US 2019/0277339 describes a free-zinc bearing oil composition for metal industry. This oil composition may comprise, by mass, relative to its total mass, 0.05% to 2% of a first phosphorus-based ash-free additive.

Document WO 2016/032246 describes a lubricating composition having excellent thermal oxidation stability and color stability. The composition may comprise a phosphorus-based secondary antioxidant.

Document U.S. Pat. No. 3,983,046 describes a composition having good fire resistance and suitable viscosity characteristics. The composition comprises a combination of at least two phosphates wherein the second phosphate may comprise an alkyl diaryl phosphate and at least one combination of two polyalkylene glycol (ester base).

In the prior art, there is a need to develop alternative anti-wear additives to tricresyl phosphate and its triaryl phosphate analogs, even if there is no unanimity on the need to obviate tricresyl phosphate and its triaryl phosphate analogs.

In the prior art, there is a particular need to develop alternative anti-wear additives having both satisfactory anti-wear effect and allowing to increase the safety level in the aviation and other aeroderivative applications:

DISCLOSURE OF THE INVENTION

In that context, the Applicant showed that specific organophosphorus compounds, some of which are known as flame retardants have satisfactory, or improved, anti-wear and thermal stability properties, and a significantly reduced, or no, neurotoxicity in comparison with that of the trialyl phosphate anti-wear derivatives such as TCP, and can therefore be advantageously used in oils for reducing the neurotoxicity of oils, and in particular of turbine oils.

They can therefore be advantageously used for the prophylaxis of aerotoxic syndrome, especially in case of fume event.

SUMMARY OF THE INVENTION

Thus the present invention relates to the use of at least one compound of formula (I)

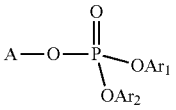

wherein A is a linear or branched alkyl group comprising 10 to 32 carbon atoms, and each of $Ar_1$ and $Ar_2$ is independently an aryl group as an anti-wear agent in an oil, preferably a turbine oil, to reduce and/or prevent the neurotoxicity of said oil.

The compounds of formula (I) have interesting anti-wear properties that can be compared to those of tricresyl phosphate of its triaryl phosphate analogs. They also present a very low, or no, risk level in terms of neurotoxicity and thus reduce the neurotoxicity of the oil into which they are embedded. Specifically, as shown by the experiment tests described below, the Applicant has discovered, unexpectedly, that the specific compounds of formula (I) above are non-toxic in terms of action on cholinesterases, non-neurotoxic, and non-reprotoxic.

The polyphosphorus compounds of formula (I) can thus be used to obtain a non-neurotoxic oil or an oil having reduced neurotoxicity.

The invention also relates to the use of an oil comprising at least one compound of formula (I)

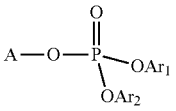

wherein A is a linear or branched alkyl group comprising 10 to 32 carbon atoms, and each of $Ar_1$ and $Ar_2$ is independently an aryl group as an anti-wear agent in an oil, preferably a turbine oil, for prophylaxis of aerotoxic syndrome, preferably in case of fume event.

Naturally, the various characteristics, variants, and embodiments of the invention may be associated with one another in a variety of combinations providing they are not incompatible or mutually exclusive.

BRIEF DESCRIPTION OF THE FIGURES

FIG. 1 shows molecules resulting from spherical harmonic modeling work. The compounds in the top line belong to cluster 1, the compounds in the bottom line belong to cluster 3 or cluster 4.

DETAILED DESCRIPTION OF THE INVENTION

A first object of the invention is the use of an oil comprising at least one compound of formula (I)

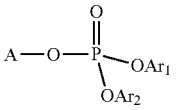

wherein A is a linear or branched alkyl group comprising 10 to 32 carbon atoms, and each of $Ar_1$ and $Ar_2$ is independently an aryl group as an anti-wear agent in an oil to reduce and/or prevent the neurotoxicity of said oil, preferably a turbine oil.

The expression "to reduce" the neurotoxicity of an oil means that the compound(s) of formula (I) according to the Invention are capable of and/or configured to reduce the neurotoxicity of an oil in which they are embedded, namely, by their presence (generally in the majority), in particular with respect to other conventional anti-wear compounds which are generally neurotoxic, the compound(s) of formula (I) make it possible to lower/decrease the neurotoxicity of an oil and to obtain a non-neurotoxic oil or at least an oil with reduced toxicity.

The expression "to prevent" the neurotoxicity of an oil means that the compound(s) of formula (I) make it possible to prevent the oil from being regarded as neurotoxic and/or to prevent the appearance of neurotoxic symptoms in a mammal, such as a human being or an animal which would be in contact with said oil; these neurotoxic symptoms can, for example, reach the central nervous system (CNS) and have the following effects: headaches, loss of appetite, drowsiness, mood and personality disorders, cognitive impairment (learning and concentration disabilities), or reach the peripheral nervous system (PNS) and have the following effects: motor impairments such as weakness, tremor, incoordination, convulsions, etc. or sensory damages, such as reduced hearing, colour vision, tinnitus, loss of equilibrium, etc.; these effects may or may not be reversible depending on the degree of acute or chronic exposure of the mammal.

The term "neurotoxicity" means the ability of a substance or compound to induce adverse effects in the nervous system of a mammal, such as a human being. The nervous system is divided into central nervous system (CNS) and peripheral nervous system (PNS). CNS is situated in the cranial cavity and the vertebral column. It comprises the brain, the brain stem, and the spinal cord. Its role consists in receiving, recording, and interpreting signals that come from the periphery. It then organizes the response to be sent. The PNS consists of nerve ganglia, sensory nerves responsible for transmitting sensations to the brain, such as pain, and motor nerves responsible for movement by stimulating muscles. They circulate information between the CNS and the organs. Thus, according to the invention, a neurotoxic substance or compound usually acts by disturbing or paralyzing the nerve impulse, in particular by acting on the synaptic emitters or receptors or on the enzymes which act on these synaptic emitters or receptors, such as cholinesterases. In biochemistry, a cholinesterase is an enzyme that catalyzes the hydrolysis reaction of a choline ester (acetylcholine, butyrylcholine) to choline and acetic acid. In physiology, this reaction is necessary to allow the cholinergic receptors to return to their rest state after activation.

In particular, "neurotoxicity" differs from the broader and global notion of "toxicity".

Specifically, "toxicity" is a fairly broad concept that includes, in particular:

- reprotoxicity, which corresponds to the impairment of the fertility or alteration of the unborn mammal),
- mutagenicity, which is the propensity of a substance to cause genetic mutations,
- acute toxicity is the toxicity induced, within a short period of time (e.g. 24 hours), by the administration of a single (possibly massive) dose or several doses acquired within that period of time of a toxic product or mixture (natural or chemical),
- ecotoxicity, which is all the imbalances or nuisances caused by an industrial activity or the placement of a foreign body or product in a natural environment;
- neurotoxicity as defined above.

However, as shown by the experimental tests below, a compound may, for example, not be reprotoxic, show no signs of acute toxicity, or even show no CMR (carcinogenic, mutagenic, or toxic for the reproduction) characteristic on human health and may, however, be highly neurotoxic (or conversely).

In the present application, the Applicant has demonstrated that, unexpectedly and surprisingly, certain specific phosphorus compounds of formula (I) above, and in particular those comprising a diphenylphosphate group, have both an excellent anti-wear property adapted in particular to the demanding field of aeronautics, while being weakly or not at all neurotoxic. This latter quality thus makes it possible to reduce and/or prevent the neurotoxicity of an oil in which they are embedded.

These tests also show that the compounds of formula (I) selected by the Applicant are not arbitrary and have a different technical effect (i.e. they make it possible to reduce/prevent the neurotoxicity of an oil) compared with other anti-wear compounds, in particular compared with other phosphorous anti-wear compounds.

For the present invention, the Applicant has demonstrated the non-neurotoxicity of the specific compounds of formula (I) both by in vitro experiment tests relating to cholinesterases and by modelling tests (3D molecular modelling by spherical harmonics and QSAR modelling for neurotoxicity and for reprotoxicity).

Preferably, the 50% (Inhibitory concentration of said at least one compound of formula (I) on the biological activity of an acetylcholinesterase (AChE) enzyme, called $IC_{50}$ hAChE is greater than or equal to 15 mg/L, and the activity on a butyrylcholinesterase enzyme, called $IC_{50}$ eqBuChE is greater than or equal to 15 mg/L, preferably equal to or greater than 20 mg/L, in particular equal to or greater than 25 mg/L and typically equal to or greater than 30 mg/L.

According to the invention, a value greater than or equal to 15 mg/L for $IC_{50}$ hAChE includes the following values and all the intervals between these values: 15; 16; 17; 18; 19; 20; 21; 22; 23; 24; 25; 26; 27; 28; 29; 30; 31; 32; 33; 34; 35; 36; 37; 38; 39; 40, etc.

Also, according to the invention, a value greater than or equal to 15 mg/L for $IC_{50}$ eqBuChE includes the following values and all the intervals between these values: 15; 16; 17; 18; 19; 20; 21; 22; 23; @4; 25; 26; 27; 28; 29; 30; 31; 32; 33; 34; 35; 36; 37; 38; 39; 40; 45; 50; 55; 60; 65; 70; 75; 80; 85; 90; 95; 100; 105; 110; 115; 120; 125; 130; 135; 140; 145; 150; 155; 160; etc.

Advantageously, the compound(s) of formula (I) belong to cluster 3 or to cluster 4, in particular to cluster 4, determined according to molecular modelling by spherical harmonics as described in the publication "Benchmarking of HPCC: A novel 3D molecular representation combining shape and pharmacophoric descriptors for efficient molecular similarity assessments», Karaboga et al. 2013 Journal of Molecular Graphics and Modelling 41:20-30.

According to another characteristic of the invention, the compound(s) of formula (I) have a percentage value by quantitative structure activity relationship (QSAR) modelling less than or equal to 0.70, for the measurement of neurotoxicity and less than or equal to 1.5, preferably less than or equal to 1.15 and typically less than or equal to 0.7 for the measurement of reprotoxicity.

Thus, the compounds of formula (I) according to the invention have a risk level in terms of neurotoxicity which is very low and which generally corresponds to a score of 0 or to a score of 1 (very low or non-existent risk of neurotoxicity), preferably to a score of 0.

The risk level as defined above and also illustrated in the experiment part below is very exhaustive and encompasses all the data obtained via the various tests on neurotocixity described above and therefore encompasses both in vitro tests and 3D modelling tests.

In particular, the risk level takes into consideration all of the following tests:

the in vitro acetylcholinesterase (AChE) inhibition test, the in vitro butyrylcholinesterase (BuChE) inhibition test, the type of cluster taking into account the shape and functionality of spherical harmonics (3D modelling), the semi-empirical prediction of neurotoxicity, and the semiempirical prediction of reprotoxicity.

By "oil" is meant in the present invention any organic material, especially any hydraulic or turbine oil liable to create pollution in the form of gas and/or aerosol in the cabin. In some embodiments, the oil is selected from the group consisting of oils for aircraft or aeroderivative turbines, helicopter transmission oils and weapon fluids. Preferably, in the present invention, the oil is an oil for aircraft or aeroderivative turbines.

By "alkyl group" of the moiety "A" is meant a linear or branched saturated hydrocarbon group. The alkyl groups comprise 10 to 32 carbon atoms ($C_{10}$ to $C_{32}$). According to a first characteristic of the invention, the alkyl groups comprise 10 to 20 carbon atoms ($C_{10}$ to $C_{20}$), preferably 10 to 15 carbon atoms, and in particular 10 to 12 carbon atoms. According to another characteristic of the invention, the alkyl groups comprise 20 to 32 carbon atoms, preferably 15 to 32 carbon atoms, and typically 16 to 32 carbon atoms. Examples of alkyl groups according to the invention include decyl, isodecyl, dodecyl, isododecyl, octadecyl, 2-butyloctyl, 2-hexyldecyl, 2-octyldodedyl and 2-tetradecyloctadecyl groups.

An alkyl group according to the invention may optionally be substituted. By "substituted aralkylene group" according to the invention is meant a linear or branched saturated hydrocarbon chain, comprising 10 to 32 carbon atoms ($C_{10}$ to $C_{32}$) substituted, at one or more of its atoms, by at least one substituent selected from the group consisting of $C_1$ to $C_{18}$ alkyl groups, OH hydroxyl group, $NH_2$ or NHR primary amine group with R an alkyl or aryl group, O-phosphate group, such as O-diphenylphosphate group, and halogen atoms.

The substitution of the alkyl or aryl groups in the compounds according to the present invention by each type of substituent makes it possible to give the compound desired properties. For example, the substitution by halogen atoms could make it possible to improve the extreme pressure and/or anti-wear effects of the compounds.

Preferably, the "alky, group" is not substituted.

By "aryl group" is meant a monocyclic or polycyclic aromatic carbon group optionally interrupted by one or more heteroatoms which can be selected from the group consisting of nitrogen atom, oxygen atom and sulfur atom. Each aromatic or polyaromatic ring comprises 5 to 14 atoms. Each ring may optionally be substituted, at one or more of its atoms, by at least one substituent selected from the group consisting of $C_1$ to $C_{18}$ alkyl groups, preferably a linear or branched $C_1$ to $C_{10}$alkyl group or a $C_1$ to $C_{18}$ alkylene group comprising a perfluorinated group, an OH hydroxyl group, an $NH_2$ primary or NHR secondary amine group with R an alkyl or aryl group, an O-phosphate group such as the O-diphenylphosphate group O—P(=O)$(OPh)_2$, an ester group and/or halogen atoms.

In general, the aromatic or polyaromatic ring as described above is not substituted or is only substituted by one or more linear or branched $C_1$ to $C_{18}$, preferably $C_1$ to $C_{10}$, in particular $C_1$ to $C_{10}$, typically $C_1$ to $C_3$ alkyl groups. When the aryl group is a polycyclic group in which at least two rings are linked by at least a covalent bond between two distinct atoms each belonging to one of the rings, the covalent bond between the two rings can be interrupted by at least an alkyl group such as a $C(CH_3)_2$ group, a carbonyl group or a heteroatom or heteroatomic group such as an oxygen atom, a sulfur atom, an NH or NR amine group or an sulfite group OS(O)O.

Examples of monocyclic aryl groups include in particular the phenyl group.

By "halogen atom" is meant an atom selected from the group consisting of chlorine, bromine, fluorine and iodines.

In one embodiment, "A" is selected from the group consisting of isodecyl group, dodecyl group, especially n-dodecyl group, tridecyl group, especially iso-tridecyl group, hexadecyl group, octadecyl group, 2-butyl-1-octyl group, 2-hexyl-1-decyl group, 2-octyl-1-dodecyl group and 2-tetradecyl-1-octadecyl group.

In one embodiment, "A" is selected from the group consisting of isodecyl group, dodecyl group, especially n-dodecyl group, and 2-octyl-1-dodecyl group.

"A" is preferably an isodecyl group.

In one embodiment, "$Ar_1$ and $Ar_2$" are independently unsubstituted phenyl or substituted phenyl, preferably substituted by at least one ester substituent or alkyl substituent such as a methyl group, an ethyl group, an isopropyl group or a tert-butyl group. Preferentially, $Ar_1$ and $Ar_2$ are two unsubstituted phenyls. In an alternative embodiment, $Ar_1$ and $Ar_2$ are two substituted phenyls, preferably substituted by an alkyl substituent such as a methyl group.

In one embodiment, the compound of formula (I) is selected from the group consisting of isodecyl diphenylposphate, n-dodecyl diphenylphosphate, isotridecyl diphenylphosphate, hexadecyl diphenylphosphate, octadecyl diphenylphosphate, 2-butyl 1-octyl diphenylphosphate, 2-hexyl 1-decyl diphenylphosphate, 2-octyl 1-dodecyl diphenylphosphate, 2-tetradecyl 1-octadecyl diphenylphosphate, and any mixtures thereof.

In an embodiment, the compound of formula (I) is selected from the group consisting of isodecyl diphenylphosphate, n-dodecyl diphenylphospate, 2-octyl 1-dodecyl diphenylphosphate, and any mixtures thereof.

In an embodiment, the compound of formula (I) is isodecyl diphenylphosphate. It may be present in the oil as an anti-wear agent in a mixture with at least another compound of formula (I). Alternatively, isodecyl diphenylphosphate is the only compound of formula (I) included in the oil. In an embodiment, isodecyl diphenylphosphate is the only anti-wear agent in the oil.

The oil in which the compound of formula (I) is used as an anti-wear agent does not preferably comprise tricresyl phosphate. In an embodiment, it does not substantially comprise tricresyl phosphate.

In another embodiment, the oil contains the compound(s) of formula (I) as single anti-wear agent(s).

In general, the anti-wear agent according to the invention of general formula (I) represents, by mass, relative to the total mass of the anti-wear agents present in the oil, from 50% to 100%, preferably from 80% to 100%, and in particular from 90% to 100% and typically 100%.

According to the invention, "50% to 100%" means the following values or any interval between these values: 50; 55; 60; 65; 70; 75; 80; 85; 90; 95; 100.

In some embodiments, the oil in which the compound of formula (I) is used according to the invention does not substantially comprise, preferably does not comprise, any triaryl phosphate anti-wear additive.

In some embodiments, the oil used in which the compound of formula (I) is used according to the invention does not substantially comprise, preferably does not comprise, any organophosphate anti-wear additive other than the compound(s) of formula (I).

In some embodiments, the oil in which the compound of formula (I) is used according to the invention does not substantially comprise, preferably does not comprise, any anti-wear additive other than the compound(s) of formula (I).

The oil is preferably an oil for aircraft or aeroderivative turbines.

The use of at least one compound of formula (I) as anti-wear agent for reducing and/or preventing and/or avoiding the neurotoxicity of an oil is particularly advantageous in situations where individuals are likely to be exposed to the oil. In fact, the compounds of formula (I) have, as demonstrated in the present invention, a very low, or even no, risk level in terms of toxicity, in particular in terms of neurotoxicity, or even of reprotoxicity, and are therefore good alternatives to conventional anti-wear agents, such as tricresyl phosphate and its triaryl phosphate analogs which are known to be neurotoxic and reprotoxic.

Also, in another embodiment, the use of the at least one derivative of formula (I) as anti-wear agent in an oil is for the prophylaxis of aerotoxic syndrome, in particular in case of fume event.

In a particular embodiment, the use of the at least one derivative of formula (I) as anti-wear agent in an oil for the prophylaxis of aerotoxic syndrome in case of fume event. For example, the use of the at least one derivative of formula (I) as anti-wear agent in an oil may be for lubricating at least one aircraft or aeroderivative turbine, for the prophylaxis of aerotoxic syndrome, in particular in case of fume event.

Preferably, the 50% inhibitory concentration of said at least one compound of formula (I) on the biological activity of an acetylcholinesterase (AChE) enzyme, called $IC_{50}$ hAChE is greater than or equal to 15 mg/L, and the activity on a butyrylcholinesterase enzyme, called $IC_{50}$ eqBuChE is greater than or equal to 15 mg/L, preferably equal to or greater than 20 mg/L, in particular equal to or greater than 25 mg/L and typically equal to or greater than 30 mg/L.

According to the invention, a value greater than or equal to 15 mg/L for $IC_{50}$ hAChE includes the following values and all the intervals between these values: 15; 16; 17; 18; 19; 20; 21; 22; 23; 24; 25; 26; 27; 26; 29; 30; 31; 32; 33; 34; 35; 36; 37; 38; 39; 40, etc.

Also, according to the invention, a value greater than or equal to 15 mg/L for $IC_{50}$ eqBuChE includes the following values and all the intervals between these values: 15; 16; 17; 18; 19; 20; 21; 22; 23; 24; 25; 26; 27; 28; 29; 30; 31; 32; 33; 34; 35; 36; 37; 38; 39; 40; 45; 50; 55; 60; 65; 70; 75; 80; 85; 90; 95; 100; 105; 110; 115; 120; 125; 130; 135; 140; 145; 150; 155; 160; etc.

Advantageously, the compound(s) of formula (I) belong to cluster 3 or to cluster 4, preferably to cluster 4, determined according to molecular modelling by spherical harmonics as described in the publication: "Benchmarking of HPCC: A novel 3D molecular representation combining shape and pharmacophoric descriptors for efficient molecular similarity assessments», Karaboga et al. 2013 Journal of Molecular Graphics and Modelling 41; 20-30.

According to another characteristic of the invention, the compound(s) of formula (I) have a percentage value (%) by quantitative structure activity relationship (QSAR) modelling less than or equal to 0.70%, for the measurement of neurotoxicity and less than or equal to 3%, preferably less than or equal to 1.5% and typically less than or equal to 0.15%, preferably less than or equal to 0.7% for the measurement of reprotoxicity.

Naturally, the various embodiments described above for the use of the compounds of formula (I) as anti-wear agents to reduce and/or prevent the neurotoxicity of an oil also apply to the use of these compounds of formula (I) for the prophylaxis of aerotoxic syndrome, in particular in case of fume event, and to the oil as such.

The term "prophylaxis of aerotoxic syndrome" refers to the decrease in the occurrence and/or the intensity, or the virtual or total disappearance, of at least one symptom identified as being related to acute or chronic exposure of individuals to the air of aircraft cabin contaminated by oils such as turbine oils or hydraulic oils in the form of gases and/or aerosols. In some embodiments, prophylaxis of aerotoxic syndrome means the decrease in the occurrence, or the virtual or total disappearance, of several symptoms, preferably, of all symptoms, identified as being related to acute or chronic exposure of individuals to the air of aircraft cabin contaminated by oils such as turbine oils or hydraulic oils in the form of gases and/or aerosols.

In particular, the symptom can be a neurological, neurobehavioral, neuromotor symptom and/or a symptom related to reproduction. Symptoms whose occurrence and/or intensity may be diminished by the use according to the invention include for example psychological or psychosomatic disorders, chronic fatigue syndrome, severe migraine headaches, multiple chemical sensitivity, mystery viral infections, sleep disorders, depression, stress and anxiety.

The term "fume event" refers to acute or chronic exposure, preferably acute, of at least one individual to the air of aircraft cabin contaminated by oils such as turbine oils or hydraulic oils in the form of gases and/or aerosols. A fume event, if it is significant; can in particular be detected by the perception of an unpleasant characteristic odor, typical of "dirty socks" or "wet dogs": In the most severe cases, for example, following the breakage of a bearing in the turbine, a smoke or thick white mist could be visible.

The expression "an oil that does not include tricresyl phosphate" refers to an oil in which the amount of tricresyl phosphate, regardless of its type of substitution (ortho, meta, para) is less than the detection limit of usual analytical techniques such as for example the gas chromatography-mass spectrometry. A technique suitable for detecting tricresyl phosphate in oil is described, for example, in De Nola G. et al., *J. Chromatogr. A* 2008; 1200 (2), pp. 211-216.

In the case of aeroderivative turbines, the pathology referred to as "aerotoxic syndrome" is a pathology with at least some of the same neurological and reproductive symptoms as those observed in aircrafts for aerotoxic syndrome, but which is contracted by exposure to organophosphates, such as tricresyl phosphate, in installations with industrial ground turbines such as offshore platforms.

The invention thus makes it possible to form an oil comprising at least one compound of formula (I)

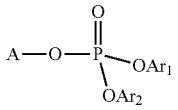

wherein A is a linear or branched alkyl group comprising 10 to 32 carbon atoms, and each of Ar1 and Ar2 is independently an aryl group, having a neurotoxicity which is low or close to zero.

This oil can also be used for the prophylaxis of aerotoxic syndrome.

In another embodiment, the oil is used for the prophylaxis of aerotoxic syndrome in case of fume event.

In particular, the oil used for the prophylaxis of aerotoxic syndrome, especially in case of fume event, is an oil for lubricating aircraft or aeroderivative turbines.

The composition of the oil suitable for the invention will be described below.

The expression "substantially not" as used in the present invention means amounts of less than 0.1% by weight relative to the total weight of the oil, preferably less than 0.05%, in particular less than the detection limit of the detection techniques.

The compounds of formula (I) are present in the oil in the present invention in such an amount as those conventionally used in the art. For example, they can be used in an amount of from 0.1 to 10 wt. %, preferably 0.5 to 5 wt. % based on the total weight of the oil.

The oil according to the invention preferably comprises an ester base, at least one amine antioxidant, and at least one anti-wear additive of formula (I).

In some embodiments, the oil according to the invention also comprises at least one further additive. The at least one further additive can especially be selected from the group consisting of lubricant agents, other anti-wear additives, antioxidants, metal corrosion inhibitors, passivators, viscosity index: improvers, detergents or dispersing agents, defoamers, surfactants, blowing agents, tackifiers, stabilizers, bulking agents, hydrolysis stabilizers, additives suitable for extreme pressures, pigments and odor-masking agents. Such additives and agents are well known to those skilled in the art and are commercially available.

The ester base is a conventional ester base well known in the art. It is typically synthetic oil that can be selected from monohydric alcohol or polyhydric alcohol esters, preferably polyhydric alcohol esters, with a mono or dicarboxylic acid reagent.

Particularly suitable polyhydric alcohols are neopolyols such as neopentyl glycol, 2-ethyl-2-methylpropane-1,3-diol, trimethylol ethane, trimethylol propane, trimethylol butane and mono-, di- or tri-pentaerythritol.

Other suitable polyhydric alcohols include any polyhydric alcohol of the formula $$R(OH)_p$$

wherein R is an optionally substituted linear, branched or cyclic aliphatic hydrocarbon moiety, and p is an integer equal to or greater than 2. The polyhydric alcohol can be selected from the group consisting of 2-ethyl-1,3-hexanediol, 2-propyl-3,3-heptanediol, 2-butyl-1,3-butanediol, 2,4-dimethyl-1,3-butanediol, ethylene glycol, propylene glycol and polyalkylene glycols.

Particularly suitable monohydric alcohols are neoalcohols such as 2,2,4-trimethylpentanol and 2,2-dimethylpropanol. Alternatively, the monohydric alcohol can be selected from the group consisting of the methyl, butyl, isooctyl and octadecyl alcohols.

The carboxylic acid reagent used to form the ester with the monohydric or polyhydric alcohol can be selected from optionally substituted aliphatic carboxylic acids comprising one or two carboxylic acid functions or any mixtures thereof. The person skilled in the art will know how to select the carboxylic acids to be used depending on the desired properties for the ester and on the monohydric or polyhydric alcohol used.

Ester bases that may be contained in an oil according to the invention include the octyl acetate, decyl acetate, octadecyl acetate, methyl myristate, butyl stearate, methyl oleate monoesters, as well as the dibutyl phthalate, dioctyl adipate, di-2-ethylhexyl azelate and ethylhexyl sebacate polyesters. Polyol ester-type base oil can be an oil prepared from technical pentaerythritol or trimethylol propane and a carboxylic acid mixture having from 4 to 12 carbon atoms. The technical pentaerythritol is a mixture that comprises from about 85% to 92% by weight of monopentaerythritol and from 8% to 15% by weight of dipentaerythritol.

A commercially available conventional technical pentaerythritol contains about 88% by weight of monopentaerythritol and about 12% by weight of dipentaerythritol, based on the total weight of said ester-type base oil. The technical pentaerythritol may also contain an amount of tri- and tetra-pentaerythritols usually formed as by-products during the technical pentaerythritol production.

Aromatic amine antioxidants are well known in the art and can be monomeric or polymeric aromatic amine antioxidants belonging to the family of aromatic amines and/or phenolic compounds.

Monomeric aromatic amine antioxidants may comprise especially at least one diphenylamine unsubstituted or substituted by at least one hydrocarbon group, at least one naphthylphenylamine unsubstituted or substituted by at least one hydrocarbon group, at least one phenothiazine unsubstituted or substituted by at least one hydrocarbon group, or any mixture thereof. The hydrocarbon groups substituting the amines are ($C_1$ to $C_{30}$) alkyl groups, or styrene.

Polymeric aromatic amine antioxidants are the polymerization products of aromatic amine antioxidants as defined above, either with each other or in the presence of a different comonomer. Examples of oligomeric or polymeric aromatic amine antioxidants that can be used in oils according to the invention include those described in the patent applications FR 2 924 122 and WO 2009/071857.

The present invention may thus relate to a method for manufacturing an oil which is non-neurotoxic or has a significantly reduced neurotoxicity (in comparison with tricresyl phosphate based oils and its analogs or oils containing other neurotoxic phosphorus compounds) used in particular for lubricating devices/machines, such as aircraft or aeroderivatives turbines, comprising the following step: incorporating into a base oil, such as an ester oil, at least one anti-wear agent, characterized in that said at least one anti-wear agent is selected from at least one compound of formula (I)

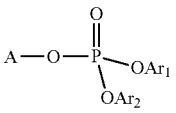

wherein A is a linear or branched alkyl group comprising 10 to 32 carbon atoms, and each of $Ar_1$ and $Ar_2$ is independently an aryl group and having in particular a risk level in terms of neurotoxicity of 0.

Naturally, the various embodiments described above for the use of compounds of formula (I) to prevent and/or reduce the neurotoxicity of an oil or for the oil composition also apply to this method for manufacturing an oil and will not be repeated below.

The present invention may thus relate to a method for lubricating a machine/device, such as aircraft or aeroderivative turbines, comprising the following steps:

providing an oil non-neurotoxic or with a significantly reduced toxicity (risk level at a score of 0), preferably free of tricresyl phosphate and/or its analogs, said oil comprising at least one anti-wear agent selected from a compound of formula (I)

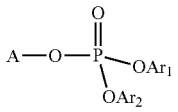

wherein A is a linear or branched alkyl group comprising 10 to 32 carbon atoms, and each of $Ar_1$ and $Ar_2$ is independently an aryl group and having in particular a risk level in terms of neurotoxicity of 0, applying an effective amount of said oil to said machine/device.

Naturally, the various embodiments described above for the use of polyphosphorus compounds to prevent and/or reduce the neurotoxicity of an oil or for the oil composition also apply to this method for lubricating and will not be repeated below.

EXAMPLES

Example 1: Toxicity Study and in Particular Neurotoxicity Study

The compounds of formula (I) according to the invention were studied and compared to other phosphorus compounds, including to TCP, in terms of cholinesterase inhibition, 3D molecular modelling by spherical harmonics, and in terms of QSAR modelling for the neurotoxicity and the reprotoxicity. The correlation between the results obtained made it possible to determine a "safety level" for the use of these compounds as anti-wear agents in oils for aircraft or aeroderivative turbines.

Protocol of the Different Tests Performed:

Inhibitory Concentration Measurement on Two Cholinesterases:

In the extent that the toxic activity of TCP especially involves its action on cholinesterases, the effect of the compounds used according to the invention, as well as comparative compounds, on two cholinesterases was studied. The required concentration values of each compound to inhibit 50% of the activity of two cholinesterases were measured. The higher the 50% inhibitory concentration ($IC_{50}$), the less the compound is neurotoxic since it has a weaker action on the cholinesterase.

The inhibitory capacity of the compounds on the acetylcholinesterase (AChE) and butyryicholinesterase (BuChE) biological activity was assessed using the spectrometric method of Ellman (Ellman et al., *Biochem. Pharm.* 1961, 7, 88-95).

The acetylthiocholine and butyrylthiocholine iodide, and 5,5-dithiobis(2-nitrobenzoic) acid (DTNB) were purchased from Sigma Aldrich (Steinheim, Germany).

The BuChE freeze-dried from equine serum (eqBuChE, Sigma Aldrich) was dissolved in 0.1M phosphate buffer (pH 7.4) to obtain enzyme stock solutions with an enzymatic activity of 2.5 units/mL. The human erythrocyte AChE (hAChE, aqueous buffer solution, ≥500 units/mg of protein (BCA), Sigma Aldrich) was diluted in 20 mM HEPES buffer, pH 8, with 0.1% Triton X-100 to obtain enzymatic solution with an enzymatic activity of 0.25 unit/mL.

In the procedure, 100 μL of 0.3 mM DTNB dissolved in phosphate buffer, pH 7.4, were added in 96-well plates, followed by 50 μL solution of the test compound and 50 μL enzyme (final 0.05 U). After 5 minutes of pre-incubation at 25° C., the reaction was initiated by injecting 50 UL of 0.1 mM acetyl or butyryl thiocholine iodide solution. The acetyl or butyryl thiocholine hydrolysis was followed by the formation of yellow 5-thio 2-nitrobenzoate anion as the product of the reaction of DTNB with the thiocholine released by the enzymatic hydrolysis of the acetyl or butyryl thiocholine, at a wavelength of 412 nm, using a microplate reader (Synergy 2, Biotek, Colmar, France). The compounds to be tested were dissolved to $5\times10^{-3}$M in analytical grade DMSO. Donepezil or tacrine were used as reference standards. The absorption increase rate at 412 nm was determined 4 minutes after the addition of the acetyl or butyryl thiocholine iodide solution. The tests were carried out with a blank containing all the compounds except the acetyl or butyryl thiocholine in order to take into account non-enzymatic reactions.

The percentage of inhibition due to the presence of the test compounds was calculated using the following expression:

$$((v0-vi)/v0)\times100 \quad \text{[Math 1]}$$

wherein $v_i$ is the rate calculated in the presence of the inhibitor, and $v_0$ is the enzymatic activity.

$IC_{50}$ values were graphically determined by plotting the percentage of inhibition as a function of the logarithm of six inhibitor concentrations in the test solution using the GraphPadPrism software (version 6.01, GraphPad Software, La Jolla, Calif., USA). All the experiments were carried out in n=3.

Molecular Modelling by Spherical Harmonics

The 3D modelling method used in the invention is described in the publication: "Benchmarking of HPCC: A novel 3D molecular representation combining shape and pharmacophoric descriptors for efficient molecular similarity assessments», Karaboga et al. 2013 Journal of Molecular Graphics and Modelling 41:20-30.

Two clusters (clusters 1 and 2) were defined by similarity from especially the monophosphate compounds known to be toxic.

The study of the compounds of formula (I) used according to the invention showed that they belong to different clusters (clusters 3 and 4) related to non-toxic molecules.

Modelling by QSAR

The neurotoxicity and reprotoxicity degrees of compounds used according to the invention and other monophosphate compounds were assessed by QSAR (Quantitative Structure-Activity Relationship) modelling.

Selection of the Training and Validation Sets

The training set was defined with chemical structures compiled from several publicly available sources: HSBD (Hazardous Substances Data Bank), EPA (U.S. Environmental Protection Agency), ECHA (European Chemicals Agency) and NTP (National Toxicology Program). 247 compounds were classified as neurotoxic compounds, 2214 compounds were classified as reprotoxic compounds and 1697 compounds were classified as neither neurotoxic nor reprotoxic and forming the non-toxic training set.

The validation set was built using compounds derived from data sets different from those used for the training set. The molecules already found in the training set have been removed. The validation set was comprised of 70 compounds classified as neurotoxic compounds, 506 compounds classified as reprotoxic and 256 compounds classified as neither neurotoxic nor reprotoxic and forming the non-toxic validation set.

Performance of the QSAR Model

A Generalized Linear Model (GLM) method has been chosen to perform a Quantitative Structure/Activity Relationship (QSAR) approach. The GLM models were separately trained to discriminate the chemical structures (i) between neurotoxic and non-neurotoxic compounds and (ii) between reprotoxic and non-reprotoxic compounds. This approach resulted in a GLM model with 210 significant descriptors within the training sets. During the training, the performance of the QSAR models was measured by ROC (Receiver Operator Characteristic) curves and gave rise to Area Under Curve (AUC) values of 0.90 and more for the prediction of the neurotoxicity and the reprotoxicity, respectively.

To validate the robustness of the QSAR models, they were then used to predict (i) the neurotoxicity categories of the compounds of the validation set (i.e. neurotoxic/non-neurotoxic categorization), (ii) the reprotoxicity categories of the compounds of the validation set (i.e. reprotoxic/non-reprotoxic categorization). During the validation, the performance of the QSAR models was measured by area under the curve (AUC) values and provided significant values of 0.70 and more for the prediction of the neurotoxicity and the reprotoxicity, respectively.

The GLM-based QSAR models were then used to study the arylic diphosphorus compounds according to the invention.

Synthesis of the Compounds of Formula (I)

In a four-necked flask fitted with a stir bar, a coolant, a separating funnel, a thermowell and a nitrogen bubbler, are introduced 1 molar equivalent of the alcohol reagent and 2 molar equivalents of triethylamine. The reaction medium was diluted with toluene, about 10 volumes relative to the alcohol reagent. Depending on the nature of the alcohol reagent, the reaction medium is heated between 25-90° C. and then, by using the separating funnel, 1 molar equivalent of diaryl phosphate chloride are introduced dropwise. At the end of the reaction, the triethylamine salt formed was removed by filtration and then washed with 5 volumes of ethyl acetate. Then the filtrate was washed two times with 0.1N HCl solution, two times with 0.1N KOH solution and then with water to neutral pH. The organic layer was then dried with $MgSO_4$, filtered, and then concentrated under reduced pressure. The resulting reaction crude was purified either by silica gel chromatography or by liquid-liquid extraction, or by precipitation. The thus obtained phosphates were characterized by GC or GPC chromatographies, by $^1H$ and/or $^{31}P$-NMR analyses. The yields obtained range from 52 to 90%.

Results

The results of the tests performed are shown in Table 1 below. The last column corresponds to a risk level score for the safety of these molecules for use in oils such as turbine oils and their alleged cabin toxicity. A score of 5 corresponds to a very high risk in terms of neurotoxicity and/or reprotoxicity, whereas scores of 0 or 1 correspond to a very low or no risk level. The risk level is determined by the sum of the factors corresponding to each of the independently evaluated risks based on the in vitro experimental results of inhibition (hAChE $IC_{50}$ and eqBuChE $IC_{50}$), semi-empirical prediction (neurotoxicity QSAR model and reprotoxicity QSAR model) and molecular modelling via spherical harmonics (clustering) and it can range from 0 to 5. A 0 value indicates a lack of risk, and a 5 value indicates a very high multiple risk. For each risk, a factor 0 or 1 is assigned based on whether the value is above or below a threshold. The following thresholds are applied: 15 mg/L for the $IC_{50}$ for hAChE, 15 mg/L for the $IC_{50}$ for eqBuChE, 0.2% for the neurotoxicity, 3% for the reprotoxicity.

TABLE 1

| Compound | ECHA's official data | $IC_{50}$ hAChE (mg/L) | $IC_{50}$ eqBuChE (mg/L) | Spherical Harmonic Cluster | Neurotoxicity QSAR (%) | Reprotoxicity QSAR (%) | Risk level |
|---|---|---|---|---|---|---|---|
| Compound A | No CMR, no acute toxicity | 12.7 | 0.7 | Cluster 1 | 0.39 | 1.93 | 4 |
| Compound B | Not registered | 15 | 3.7 | Cluster 1 | 7.35 | 6.28 | 5 |
| Compound C | Not registered | 9.3 | 2.3 | Cluster 1 | 6.99 | 3.69 | 5 |
| Compound D | Not registered | 9.7 | 42.7 | Cluster 1 | 8.36 | 0.74 | 3 |
| Compound P | PBT* Reprotoxic (Cat 2; H361) | 16.9 | 0.7 | Cluster 1 | Yes | Yes | 4 |
| Compound E | PBT* Reprotoxic (Cat 1b, H360f) | ND | ND | Cluster 1 | 2.23 | 1.41 | ≥2 |
| Compound F | Not registered | 5.6 | 8.7 | Cluster 1 | ND | ND | ≥3 |
| Compound G | Not registered | 15.8 | 145.5 | Cluster 1 | 0.05 | 5.56 | 2 |
| Compound H | Not registered | 12.1 | 122.8 | Cluster 1 | 0.07 | 3.49 | 3 |
| Compound I1 | No CMR, no acute toxicity | 10.8 | 14.0 | Cluster 1 | 1.01 | 1.22 | 4 |
| Compound I2 | Not registered | 8.4 | 96 | Cluster 1 | 0.32 | 1.74 | 3 |
| Compound I3 | No CMR, no acute toxicity | 13.9 | 34.9 | Cluster 1 | NA (Mixture of neurotoxic compounds) | — | >3 |
| Compound J | Not registered | ND | 0.7 | Cluster 2 | 5.61 | 1.67 | 4 |
| Compound K | Not registered | 9.5 | 33.9 | Cluster 2 | 1.13 | 4.4 | 4 |
| Compound Q | Not registered | 18.4 | 1.6 | Cluster 1 | 0.58 | 2.70 | 4 |
| Compound L | No CMR, no acute toxicity | 9.1 | 13.9 | Cluster 5 | 26.31 | 1.82 | 4 |
| Compound M | No CMR, no acute toxicity | 12.2 | 121.3 | Cluster 5 | ND | ND | ≥2 |

TABLE 1-continued

| Compound | ECHA's official data | $IC_{50}$ hAChE (mg/L) | $IC_{50}$ eqBuChE (mg/L) | Spherical Harmonic Cluster | Neurotoxicity QSAR (%) | Reprotoxicity QSAR (%) | Risk level |
|---|---|---|---|---|---|---|---|
| Compound N | No CMR, no acute toxicity | 19.3 | 11.1 | ND | ND | ND | ≥1 |
| Compound 1 | No CMR, no acute toxicity | 15 | 36.3 | Cluster 4 | 0.00 | 0.69 | 0 |
| Compound 2 | No CMR, no acute toxicity | 28 | 78 | Cluster 4 | 0.00 | 0.69 | 0 |
| Compound 3 | Not registered | 22 | 82 | Cluster 3 | 0.00 | 1.12 | 0 |
| Compound 4 | Not registered | 16 | 34 | Cluster 4 | 0.00 | 0.7 | 0 |
| Compound 5 | Not registered | 23 | 27 | ND | ND | ND | ND |
| Compound 6 | Not registered | 18 | 72 | NA | NA | NA | ND |
| Compound 7 | Not registered | 23 | 127 | ND | ND | ND | ND |

ND means not determined.

NA means not applied (in case of mixtures of compounds)

*PBT: (persistent, bioaccumulative and toxic)

The compounds are numbered as follows:

Comparative examples:

Compound A: 2-ethylhexyl diphenylphosphate(CAS 1241-94-7) (https://echa.europa.eu/fr/substance-information/-/substanceinfo/100.013.625)

Compound B: Tri(ortho-cresyl)phosphate ToCP

Compound C: Tri(meta-cresyl)phosphate

Compound D: Tri(para-cresyl)phosphate

Compound P: Tricresyl phosphate (CAS 1330-78-5) corresponds to the commercial product Durad 125 (https://echa.europa.eu/fr/substance-information/-/substanceinfo/100.239.100)

Compound E: Trixylyl phosphate (CAS 25155-23-1) (https://echa.europa.eu/fr/registration-dossier/-/registered-dossier/2204/7/11/1)

Compound F: Tri(2,6-difluorophenyl)phosphate

Compound G: Tri(4-isopropylbenzoate)phosphate

Compound H: di(p-tertbutylphenyl)phenylphosphate

Compound I1: tri phenyl phosphate(CAS 204-112-2) (https://echa.europa.eu/fr/substance-information/-/substanceinfo/100.013.625)

Compound I2: Tri(p-tert-butylphenyl)phosphate

Compound I3: Tert-butylphenyl diphenyl phosphate (CAS 700-990-0) corresponds to the commercial product Durad 150B, (https://echa.europa.eu/fr/substance-information/-/substanceinfo/100.235.046

Compound J: Saligenin cresyl phosphate

Compound K: Diphenyl phosphoroamidate

Compound Q: isononyl diphenylphosphate

Compound L: Tri(isobutyl)phosphate (CAS 126-71-6) (https://echa.europa.eu/fr/substance-information/-/substanceinfo/100.004.363)

Compound M: Tris(2-ethylhexyl)phosphate (CAS 78-42-2) (https://echa.europa.eu/fr/substance-information/-/substanceinfo/100.001.015)

Compound N: Dibutyl [[bis[(2-ethylhexyl)oxy]phosphinothioyl]thio]succinate (CAS 68413-48-9) (https://echa.europa.eu/fr/substance-information/-/substanceinfo/100.063.817)

Examples according to the invention (compounds of formula (I))

Compound 1: isodecyl diphenylphosphate (CAS 29761-21-5) corresponds to the commercial product Santicizer 148 (https://echa.europa.eu/fr/substance-information/-/substanceinfo/100.239.100)

Compound 2: n-dodecyl diphenylphosphate (CAS 27460-02-2) (https://echa.europa.eu/fr/substance-information/-/substanceinfo/100.013.625)

Compound 3: 2-octyl 1-dodecyl diphenylphosphate

Compound 4: isododecyl diphenylphosphate

Compound 5: isohexadecyl diphenylphosphate (C16),

Compound 6: mixture of n-hexadecyl and n-octadecyl diphenylphosphate (nC16/C18)

Compound 7: iso-C32 diphenylphosphate

Whereas compound A: (2-ethylhexyl diphenylphosphate) belongs to cluster 1 of the neurotoxic and reprotoxic organophosphorus molecules, compound 1, which corresponds to formula (I) according to the invention, in contrast has high $IC_{50}$ inhibition values with respect to the cholinesterases hAChE and eqBuChE. Surprisingly, modelling by the spherical harmonics shows that this molecule belongs to a molecule cluster which is different from neurotoxic clusters 1 and 2. The semiempirical QSAR models also indicate a difference in reactivity. Compound 1 has a risk level equal to 0, whereas the compounds of cluster 1 have a risk level at least equal to 2.

QSAR modelling also indicates that compound 3, which corresponds to formula (I) according to the invention, belongs to a cluster different from clusters 1 and 2 of neurotoxic compounds, compounds 2 and 4 belonging to the same cluster as compound 1 (namely cluster 4), while compound 3 belongs to another cluster (namely cluster 3). These three compounds (compounds 2 to 4) also have no neurotoxicity and very low reprotoxicity. The cluster and the QSAR modelling were not determined for compounds 5 to 7 according to the invention. However, the latter compounds 5 to 7 exhibit excellent in vitro results in terms of $IC_{50}$ of cholinesterases (the 50% inhibitory concentration is high, greater than 18 mg/L for hAChE $IC_{50}$ and greater than 25 mg/L and can even reach 127 mg/L for eqBuCh $IC_{50}$). These compounds 5 to 7 thus suggest that they are non-neurotoxic since they have a weak action on the cholinesterases tested and must certainly exhibit good results in the QSAR tests, while probably being classified among clusters 3 and 4 according to the 3D modelling of spherical harmonics. It is observed that the elongation of the alkyl chairstends towards a 3-type cluster.

The compounds of formula (I) according to the invention consequently appear to have a conformation different from that of the compounds belonging to neurotoxic clusters 1 and 2, and their reactivity being also different relative to the biological activity of the enzymes studied.

The compounds of the cluster 1 are, according to the spherical harmonic 3D-modelling approach, in the form of "three-blade propeller" based on two planes perpendicular at the molecule center or core while the compounds according to the invention exhibit a rather expanded and planarized shape, similar to a butterfly form. The molecules derived from the modelling work by spherical harmonics are shown in FIG. 1. These compounds are therefore non-neurotoxic and non-reprotoxic alternatives to the tricresyl phosphate and its triaryl phosphate analogs or to the other tested phosphorus based compounds (generally also used as an anti-wear agent in a turbine oil).

Compounds 1 to 7, whose moiety A is an alkyl group comprising 10 to 20 carbon atoms, are non-neurotoxic and have such a very low reprotoxicity. In comparison, compound A and compound Q, whose moiety A is an alkyl group comprising 8 and 9 carbon atoms, respectively, have significantly higher neurotoxicity and reprotoxicity values according to QSAR models, and belong to cluster 1 of neurotoxic compounds.

Thus, these in vitro and modelling tests (3D of spherical harmonics or QSAR) show that the Applicant has selected, hon-arbitrarily, from all the existing phosphorus-based compounds generally exhibiting an anti-wear action in an oil, a restricted subset of compounds of general formula (I). This subset also has a different technical effect from other phosphorus-based compounds. In fact, this subset of compounds of formula (I) is at least non-neurotoxic and is capable of and/or is configured to reduce and/or prevent the neurotoxicity of an oil, in particular of a turbine oil intended for aviation. Moreover, this subset is capable of and/or is configured for the prophylaxis of aerotoxic syndrome, in particular in case of fume event. This subset, by virtue of its characteristics, makes it possible to form a turbine oil, for example for aviation, which is suitable for and/or configured in order to make it possible to increase the safety level in aviation and in other aeroderivative applications.

In addition, no indication in the prior art could allow a person skilled in the art to specifically select this subset of compounds of general formula (I) in order to reduce/prevent the neurotoxicity of a turbine oil or for the prophylaxis of aerotoxic syndrome.

In fact, on the one hand, the other phosphorus compounds and in particular the other phosphorus compounds used as anti-wear agent in an oil and known in the prior art do not have this novel technical effect (i.e.: reducing and/or preventing the neurotoxicity of an oil or for the prophylaxis of aerotoxic syndrome). On the contrary, the other known anti-wear compounds (comparative compounds E, I1-3, M, N and P) and in particular used as anti-wear agent in an oil, are neurotoxic.

On the other hand, prior to the tests carried out by the Applicant, most of the other commercial and registered phosphorus compounds, in particular known as anti-wear agent, such as, for example, compounds A, I1-I3, L, M and N, are recognized in particular by the official website of the European Chemical Agency (ECHA) as not presenting a serious hazard of acute or serious toxicity (CMR characteristic). ECHA is a competent authority to decide on the toxicity of registered chemicals for the European market. It publishes public and recognized scientific data. Compound I3 is used in particular in the field of lubricants to replace TCP or its analogs. However, the Applicant's tests via the $IC_{50}$ in vitro tests and the 3D or QSAR modelling tests show, on the contrary, that these compounds are highly neurotoxic. For example, according to the ECHA website, this compound is not known to be toxic to human health. However, the table 1 above shows that this compound I3 is a mixture of neurotoxic compounds including triphenyl phosphate and tri (p-tert-butylphenyl) phosphate. A person skilled in the art would therefore not have been induced or encouraged to select the subset formed by the compounds of general formula (I) in order to reduce and/or prevent the neurotoxicity of an oil or for the prophylaxis of aerotoxic syndrome.

Example 2: Anti-Wear Performance of the Compounds According to the Invention The anti-wear performance of the oils according to the invention was measured by using the 4-ball wear test in accordance with ASTM D4172 standard test method. The results obtained are shown in Table 2 below:

TABLE 2

| Anti-wear compound formulated as an aviation turbine oil | 4-ball wear (in mm) |
|---|---|
| Without anti-wear compound | 0.83 |
| TCP | 0.46 |
| Isodecyl diphenylphosphate | 0.45 |
| N-dodecyl diphenylphosphate | 0.45 |
| 2-octyl 1-dodecyl diphenylphosphate | 0.45 |

The results confirm that the compounds of formula (I) used according to the invention in oils have interesting anti-wear properties and potentially similar to those of the TCP, therefore that they are compatible with effective use as anti-wear agent, especially in oils for aircraft or aeroderivative turbines.

Of course, a variety of other modifications may be made to the invention in the context of the appended claims.

The invention claimed is:

1. A method for manufacturing an oil that is able to and/or configured to lubricate a machine and/or a device, said method comprising the following steps:

incorporating into a base oil, at least one compound of formula (I)

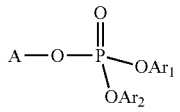

wherein A is a linear or branched alkyl group comprising 10 to 32 carbon atoms, and each of $Ar_1$ and $Ar_2$ is independently an aryl group as an anti-wear agent, wherein the at least one compound of formula (I) has a risk level in terms of neurotoxicity corresponding to a score of 0 or to a score of 1 and is capable of and/or is configured to reduce and/or prevent the neurotoxicity of said oil.

2. The method according to claim 1, wherein said at least one compound of formula (I) has a concentration value to inhibit 50% of the biological activity of an acetylcholinesterase (AChE) enzyme, called $IC_{50}$ hAChE that is greater than or equal to 15 mg/L, and of the activity on a butyrylcholinesterase enzyme, called $IC_{50}$ eqBuChE that is greater than or equal to 15 mg/L.

3. The method according to claim 2, wherein said at least one compound of formula (I) has a $IC_{50}$ eqBuChE that is greater than or equal to 20 mg/L.

4. The method according to claim 3, wherein said at least one compound of formula (I) has a $IC_{50}$ eqBuChE that is greater than or equal to 25 mg/L.

5. The method according to claim 4, wherein said at least one compound of formula (I) has a $IC_{50}$ eqBuChE that is greater than or equal to 30 mg/L.

6. The method according to claim 1, wherein A is selected from the group consisting of isodecyl, n-dodecyl and 2-octyl 1-dodecyl group.

7. The method according to claim 1, wherein $Ar_1$ and $Ar_2$ are phenyls.

8. The method according to claim 1, wherein the compound of formula (I) is selected from the group consisting of isodecyl diphenylphosphate, n-dodecyl diphenylphospate, 2-octyl 1-dodecyl diphenylphosphate, and any mixtures thereof.

9. The method according to claim 8, wherein the compound of formula (I) is isodecyl diphenylphosphate.

10. The method according to claim 1, wherein the oil does not comprise triaryl phosphate anti-wear additive.

11. The method according to claim 10, wherein the oil contains as sole anti-wear agent(s) only the compound(s) of formula (I).

12. The method according to claim 1, wherein said at least one compound of formula (I) is suitable for the prophylaxis of aerotoxic syndrome.

13. A method for lubricating a machine and/or a device for reducing the neurotoxicity of an oil, comprising the following steps:

providing the oil comprising at least one anti-wear agent selected from a compound of formula (I):

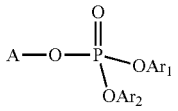

wherein A is a linear or branched alkyl group comprising 10 to 32 carbon atoms, and each of $Ar_1$ and $Ar_2$ is independently an aryl group, applying an effective amount of said oil to said machine and/or device, wherein the at least one compound of formula (I) has a risk level in terms of neurotoxicity corresponding to a score of 0 or to a score of 1 and is capable of and/or is configured to reduce and/or prevent the neurotoxicity of said oil.

14. The method according to claim 13, wherein said at least one compound of formula (I) has a concentration value to inhibit 50% of the biological activity of an acetylcholinesterase (AChE) enzyme, called $IC_{50}$ hAChE that is greater than or equal to 15 mg/L, and of the activity on a butyrylcholinesterase enzyme, called $IC_{50}$ eqBuChE that is greater than or equal to 15 mg/L.

15. The method according to claim 13, wherein A is selected from the group consisting of isodecyl, n-dodecyl and 2-octyl 1-dodecyl group.

16. The method according to claim 13, wherein $Ar_1$ and $Ar_2$ are phenyls.

17. The method according to claim 13, wherein the compound of formula (I) is selected from the group consisting of isodecyl diphenylphosphate, n-dodecyl diphenylphospate, 2-octyl 1-dodecyl diphenylphosphate, and any mixtures thereof.

18. The method according to claim 13, wherein the compound of formula (I) is isodecyl diphenylphosphate.

19. The method according to claim 13, wherein the oil does not comprise triaryl phosphate anti-wear additive.

20. The method according to claim 19, wherein the oil contains as sole anti-wear agent(s) only the compound(s) of formula (I).

21. The method according to claim 13, wherein said at least one compound of formula (I) is suitable for the prophylaxis of aerotoxic syndrome.

* * * * *